US005904896A

United States Patent [19]

High

[11] Patent Number: 5,904,896

[45] Date of Patent: May 18, 1999

[54] MULTI-STAGE ZONAL AIR PURIFICATION SYSTEM

[75] Inventor: Alan V. L. High, Garland, Tex.

[73] Assignee: A. R. Grindl, Dallas, Tex.

[21] Appl. No.: 08/968,901

[22] Filed: Nov. 6, 1997

Related U.S. Application Data

[63] Continuation of application No. 08/569,736, Dec. 8, 1995, abandoned.

[51] Int. Cl.[6] ..... A61L 9/015; B03C 3/019; F24F 9/00

[52] U.S. Cl. ..... 422/4; 422/122; 422/123; 95/70; 96/55; 96/59; 96/226; 454/189; 454/191

[58] Field of Search ..... 422/4, 120, 122, 422/123, 124; 55/279; 95/70; 96/55, 59, 63, 226; 454/187, 189, 191

[56] References Cited

U.S. PATENT DOCUMENTS

| | | | |
|---|---|---|---|
| 3,023,688 | 3/1962 | Kramer, Jr. | 454/189 X |
| 3,239,305 | 3/1966 | Potapenko | 55/279 X |
| 3,495,381 | 2/1970 | Flanagan | 96/63 |
| 3,724,172 | 4/1973 | Wood | 55/97 |
| 3,726,203 | 4/1973 | Lindestrom | 98/36 |
| 3,745,750 | 7/1973 | Arff | 55/279 X |
| 3,804,942 | 4/1974 | Kato et al. . | |
| 3,935,803 | 2/1976 | Bush | 98/36 |
| 3,972,678 | 8/1976 | Nakshbendi | 21/74 R |
| 4,426,960 | 1/1984 | Hart . | |
| 4,623,367 | 11/1986 | Paulson | 55/385 R |
| 4,629,479 | 12/1986 | Cantoni | 96/55 |
| 4,929,262 | 5/1990 | Balon, Jr. et al. | 55/341.2 |
| 5,133,788 | 7/1992 | Backus | 55/467 |
| 5,158,580 | 10/1992 | Chang | 55/6 |
| 5,160,517 | 11/1992 | Hicks et al. | 55/385.1 |
| 5,185,015 | 2/1993 | Searle | 422/121 X |
| 5,290,330 | 3/1994 | Tepper et al. | 55/276 |
| 5,302,359 | 4/1994 | Nowatzki | 422/120 X |
| 5,433,763 | 7/1995 | Shagott et al. | 96/55 X |
| 5,616,172 | 4/1997 | Tuckerman et al. . | |

*Primary Examiner*—E. Leigh McKane
*Attorney, Agent, or Firm*—Akin, Gump, Strauss, Hauer & Feld, L.L.P.

[57] ABSTRACT

An air filtration and purification system, particularly adapted for treating contaminated air within a preselected zone of a building interior space, includes a filter and purifier unit comprising first and second stage particle filters, an odor neutralizer comprising an ozone generator, an activated carbon adsorbent media for extracting gaseous compositions exposed to the ozone injected into the airflow stream and an ultrahigh efficiency final stage particle filter. All filter units and the ozone generator are disposed in a cabinet together with one or more air propulsion fans interposed between the second stage particle filter and the adsorbent media. The system is particularly configured for removing air containing tobacco smoke and other contaminants from smoking areas of restaurants and other places of business and may be configured to return purified and odorized air through ceiling ducts to form an air curtain defining the zone.

15 Claims, 4 Drawing Sheets

MULTI-STAGE ZONAL AIR PURIFICATION SYSTEM

This is a continuation of application Ser. No. 08/569,736, filed Dec. 8, 1995 now abandoned.

FIELD OF THE INVENTION

The present invention pertains to a multi-stage air purification system, particularly adapted for filtering and purifying air from indoor environments, including rooms or portions of rooms from which particulates, liquid droplets, tobacco smoke and certain gas phase pollutants are desired to be removed.

BACKGROUND

Airborne contaminants in various indoor environments have become a significant concern with regard to the health and comfort of persons occupying such, particularly in places of business, institutional and public buildings and virtually any indoor environment wherein it is desired to eliminate solid particles (dust, pollen, mold, lint, fiber), other particulates, such as tobacco smoke and certain aerosols, and gas phase pollutants, such as formaldehyde, various volatile organic compounds and other odor causing gasses. The composition and concentration of such contaminants will, of course, vary depending on the particular environment and the sources which generate various concentrations of the above-mentioned contaminants.

One particular type of indoor environment which has been subject to heightened public awareness and local and regional governmental regulation is that wherein tobacco smoke is generated. Regulations and increased public awareness of the effects of tobacco smoke have resulted in isolation of certain indoor areas wherein the smoking of cigarettes and other tobacco products is permitted. Restaurants, night clubs and taverns, for example, have been required, through regulation and public sentiment, to segregate persons using tobacco products from non-smokers within their facilities. Accordingly, this action tends to concentrate the generation of tobacco smoke and poses a significant problem in properly removing contaminated air from the area where smoking is permitted so as to provide a clean and comfortable environment for persons occupying the smoking area as well as persons occupying the non-smoking areas of the same facility.

In order to avoid costly construction work and other modifications of existing facilities and to retain the aesthetic appeal of certain facilities, such as restaurants and similar establishments, there has been a strongly felt need to provide a suitable air circulation, filtration and purification system which will remove airborne contaminants from the area where these contaminants are being generated with minimum cost while retaining a pleasant atmosphere for the occupants of the facility. These same problems arise for various other facilities, such as private business and public buildings, wherein the use of tobacco products is permitted only in certain areas or zones. Moreover, there are also other instances wherein the circulation and purification of air with respect to a particular indoor environment is required or desired and wherein contamination of the air is generated by certain work processes, for example.

Conventional indoor air conditioning systems do not properly overcome the contaminated air problems in facilities such as those mentioned above. Conventional ventilating systems, for example, usually remove contaminated air from the environment being treated and replace it with air from another environment, including outdoor contaminated air. However, bringing in outdoor air may require the removal of contaminants as well as cooling or heating the air, thereby significantly increasing energy costs. A related problem with respect to treating air drawn into the indoor environment to be controlled also pertains to the fact that using outdoor air, which may contain various gasses and volatile organic compounds which have been produced in the outdoor environment, such as from the burning of fossil fuels, does not solve the contamination problem within the particular indoor environment which is to be controlled.

Accordingly, there has been a significant and growing need for an effective air filtration and purification system which may be easily installed in existing indoor facilities, as well as newly constructed facilities, particularly for circulating and purifying air within a particular area, zone or room within the indoor facility. It is to these ends that the present invention has been developed.

SUMMARY OF THE INVENTION

The present invention provides an improved, multi-stage air filtration and purification system, particularly adapted for indoor environments, including rooms or zones within a room or rooms from which it is desired to remove solids particulates, aerosols, volatile organic compounds and other contaminants resulting from human activity, including the generation of tobacco smoke and similar contaminants.

In accordance with one aspect of the present invention, a multi-stage air filtration and purification system is provided which includes one, and preferably two, stages of relatively coarse particulate filtration, a gas phase adsorbent stage and a high efficiency or ultra-high efficiency particle filtration stage for removing particles of relatively small size in the so-called HEPA or ULPA range.

In accordance with another aspect of the invention, a multi-stage air filtration and purification system is provided which includes an odor neutralizer in the form an ozone generator which is disposed in the purification system upstream of an adsorbent or gas phase removal stage, such as an activated carbon filter. Improved purification or decontamination of an air flow stream is provided by combining ozone with gaseous materials and minute particulates in the flow stream which are then adsorbed by and/or deposited on a gas phase adsorbent media, such as activated carbon or charcoal. After removal of gas phase contaminants, aerosols, tobacco smoke, volatile organic compounds and other contaminants, the treated air is passed further through an ultra high efficiency final filter to provide a high degree of particulate filtration so that substantially odor free, purified air is provided to or returned to a selected environment.

In accordance with yet a further aspect of the present invention, a multi-stage zonal type air filtration and purification system is provided which includes at least two stages of relatively coarse particle filtration, followed by the injection of ozone into the filtered air flowstream followed by passing the airstream through a gas phase adsorbent, such as activated carbon, and finally by passing the air flowstream through an ultra high efficiency particle filter for removal of submicron particulates from the airflow stream. The air flowstream is propelled through the five stages of treatment by one or more air moving devices, preferably single stage centrifugal fans, which are advantageously disposed downstream of the coarse particle filtration stages and upstream of the gas phase adsorbent stage and final particulate filtration stage.

The present invention still further provides a unique air filtration and purification system which includes multistage treatment of air to be processed through a single cabinet which includes all stages of filtration as well as means for propelling or circulating the air to be treated. The cabinet is compact and is adapted to be mounted in existing indoor facilities such as in a false ceiling or other space. Air flowing to and from the cabinet may be easily ducted for circulation to and from a particular zone within a room in such a way that contaminated air in the zone does not escape into other parts of the room but is processed through the system for filtration, purification and odor elimination or neutralization. The system is advantageously configured in such a way that air does not escape from the zone in which contaminants are being generated but is required to flow through the filtration and purification system and is then returned unobtrusively to the zone from which it was removed. The system of the invention may be conveniently installed in many facilities independent of existing air conditioning and ventilation systems.

The overall arrangement of the filtration and purification system of the invention is advantageous in that a five stage progressive contaminant elimination process is carried out by the removal of large particulates in the first stage, and the removal of allergens, such as pollen, mold, mildew and fungi is carried out in the second stage. The third stage of treatment involves the mixing of ozone with the air to be treated to cause the ozone molecules to attach to the molecules of various gas phase and submicron particle contaminants such as volatile organic compounds, compounds generated by the burning of tobacco products, organic solvents in gaseous phase and other minute fluid particles. These contaminants, when combined with ozone molecules, are then attracted to an adsorbent, such as activated carbon or charcoal, in a fourth stage of the system, and due to the affinity of the activated carbon for the ozone molecules, these contaminants are removed from the air flowstream. Some agglomeration is also carried out by the presence of the ozone molecules with respect to minute particulates and minute liquid droplets, for example. This agglomeration process generates larger particles which are more easily trapped or filtered by the activated carbon adsorbent and by a high efficiency or ultra high efficiency particulate filter disposed downstream of the adsorbent stage. This particular arrangement improves the useful life of both the gas phase adsorbent stage and the high efficiency or ultra high efficiency particulate filter stage.

The present invention further provides a unique method of filtering and purifying air within a zone or area of an indoor environment which includes the advantageous treatment steps discussed herein.

Those skilled in the art will further appreciate the above-mentioned advantages and superior features of the invention together with other important aspects thereof upon reading the detailed description which follows in conjunction with the drawing.

DESCRIPTION OF A PREFERRED EMBODIMENT

Figure 1:
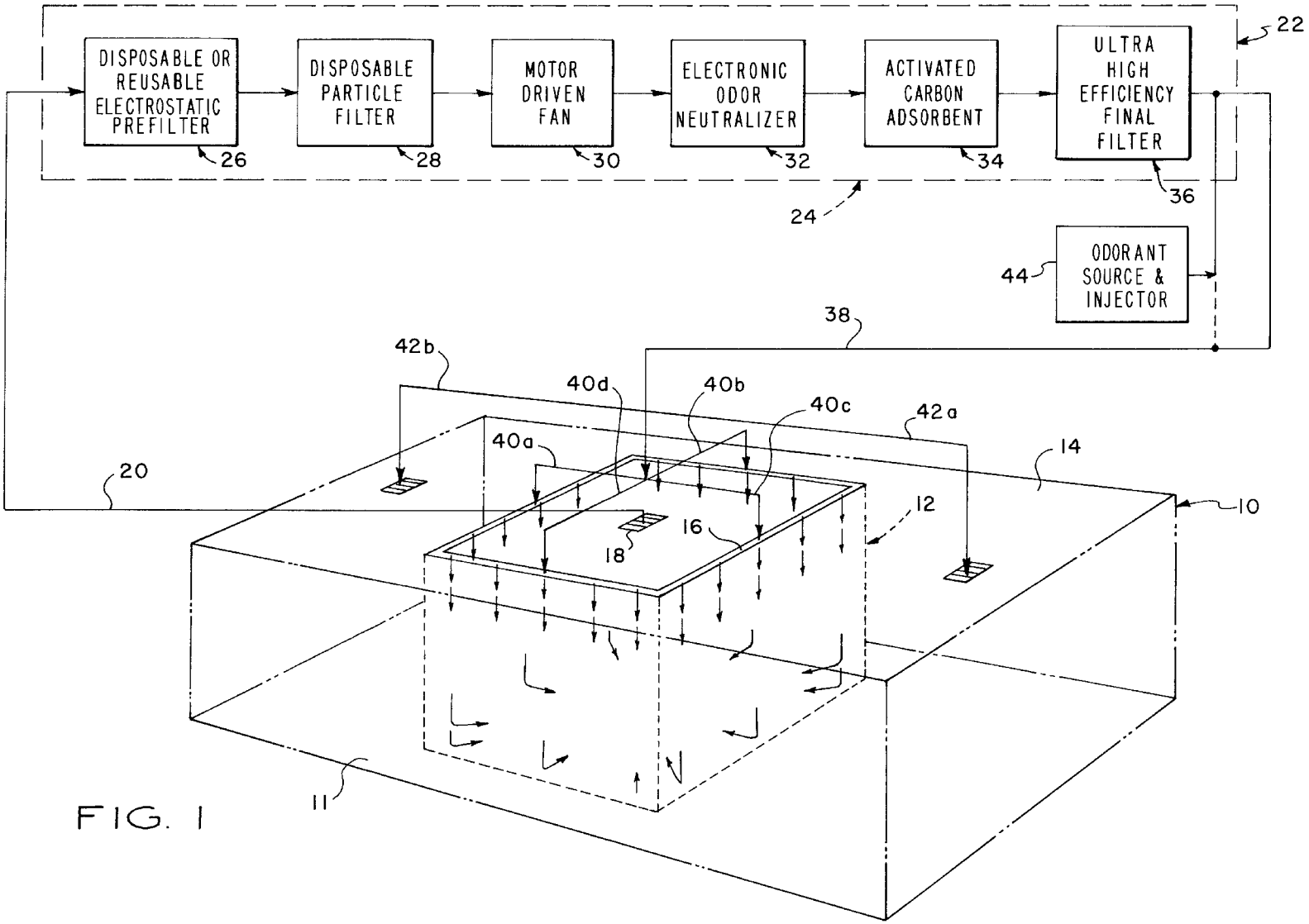
FIG. 1 is a diagram, in somewhat schematic form, showing a designated indoor area or zone within which air is withdrawn, purified and recirculated by a system in accordance with the invention.

In the description which follows, like elements are marked throughout the specification and drawing with the same reference numerals, respectively. The drawing figures are not necessarily to scale and conventional elements are shown in somewhat schematic form in the interest of clarity and conciseness.

The air filtration and purification system of the present invention may be utilized in many indoor environments for decontaminating and conditioning air with respect to a particular room or rooms within which certain contaminants are being generated or which require a high degree of purified air. However, an important application of the present invention is one in which smoke from tobacco products is being generated, such as within a business establishment or public facility, particularly a restaurant, tavern or night club, for example. In such environments, it has become typical to designate a particular zone or area of the facility to be occupied by persons smoking cigarettes and other tobacco products. Such an area or zone may be a particular portion of a room or one or more of plural interconnected rooms and may, in fact, be essentially the middle portion or zone of a large room or area within a restaurant, club, or similar establishment. The system of the present invention is particularly adapted for withdrawing, decontaminating and recirculating purified air to such a zone or area within a room while minimizing or eliminating contamination of the rest of the room and without adversely affecting the occupants of the designated zone or adjacent zones or areas.

Referring to FIG. 1, for example, there is shown a generally rectangular room or area, generally designated by the numeral 10, in an indoor environment within which a particular zone 12 is to be treated in accordance with a system of the present invention. The zone 12 may, as mentioned above, be a designated smoking area of a restaurant or similar facility. The zone 12 is shown, for illustrative purposes only, as a generally rectangular area within the confines of the generally rectangular room or zone 10. As discussed above, the system of the invention may be used in conjunction with treating air withdrawn from other designated areas or zones or an individual room or rooms of a particular facility.

The room or zone 10 is provided with a suitable ceiling structure 14 in which an elongated generally rectangular slotted opening 16 has been formed using conventional ducting and framework known to those of skill in the art of building interior construction. The elongated, slot-like perimeter opening 16 at least partially defines the perimeter of the zone 12 from which air is to be removed, treated in accordance with the system and method of the invention and returned to the zone through the perimeter opening 16. For example, the ceiling 14 may have a suitable opening 18 therein connected to a conduit or duct 20 for conducting contaminated air from within the zone 12 to a system 22 in accordance with the invention and shown schematically in FIG. 1.

As shown schematically in FIG. 1, the air filtration and purification system 22 includes a suitable enclosure or cabinet 24 within which multi-stage treatment elements are provided in a particularly unique arrangement in accordance with the invention. The duct 20 is suitably connected to the enclosure or cabinet 24 and is shown in schematic form only. The duct 20 may comprise one or more conduits connected to one or more openings 18 in the ceiling 14, for example. For illustrative purposes with regard to FIG. 1, the duct 20 as well as air return ducts described herein, are shown as single conduits.

The system 22 is preferably configured such that contaminated air removed from the zone 12 is subjected to a relatively coarse particulate removal stage by passing the contaminated air through a disposable or reusable prefilter which may be a powered or non-powered electrostatic type or a conventional impingement type. The first stage filter or prefilter unit, designated by numeral 26, is capable of removing from the air flowstream entering the cabinet 24 relatively large particulates, such as dust particles, having particle sizes in the range of 1.0 to 10.0 microns or larger, for example. Such filtration will remove at least a portion of certain dusts, mists, pollens and very large smoke particles. The particle filter unit 26 may be a powered or non-powered electrostatic type to enhance its filtration capability. A preferred embodiment of the filter unit 26 is a non-powered electrostatic particle filter formed of one or more layers of non-woven polyester, polypropylene, fiberglass or other media having relatively low resistance to air flow therethrough. The media is preferably supported in a suitable frame, not shown in FIG. 1, and to be described in further detail herein.

Air treated by the filter unit 26 is then passed through a disposable particle filter unit 28, acting as a second stage particle filter, which substantially removes all particulates from the air flowstream having a particle size greater than about 0.3 microns. The filter unit 28 is preferably configured as a so-called V bag, pleated or corrugated type filter units having a media formed from high density microfibers and is, typically, not reusable. The filter unit 28 is, however, capable of removing some particles of tobacco smoke and other particulates of products of combustion, as well as relatively fine dust or powder particles.

A preferred arrangement of the system 22 includes, in the air flowpath, one or more motor driven fans 30 interposed between the filter unit 28 and a third stage of treatment comprising an odor neutralizer unit 32. Accordingly, air to be treated by the system 22 is initially passed through the large particulate or so called prefilter unit 26, the primary particulate filter unit 28, then mechanically handled by the fan or fans 30 and then treated by the odor neutralizer 32. The odor neutralizer 32 is preferably configured as an ozone generator for injecting ozone into the air flowstream passing through the cabinet 24 downstream of the fan or fans 30. Ozone molecules generated by the odor neutralizer unit 32 are operable to agglomerate some fine particulates, including very fine mists and smoke particles, into relatively larger particles which may be trapped by fourth or fifth stages of treatment provided by the system 22. Moreover, the ozone molecules generated by the odor neutralizer unit 32 are operable to bond to molecules of various gaseous compositions including volatile organic compounds and other chemical vapors. The ozone generator may be interposed in the air flowstream such that substantially all of the air passing through the system 22 passes through the unit 32, or the unit 32 may be placed in the air flowstream in such a way that a sufficient amount of ozone is generated to thoroughly mix with substantially all of the air flowstream passing through the system 22.

FIG. 1 further illustrates, in schematic form, a gaseous contaminant adsorbent unit 34 interposed in the cabinet 24 downstream of the odor neutralizer unit 32 and operable to adsorb gaseous contaminants in the air flowstream, including those which have been exposed to the ozone molecules generated by the odor neutralizer unit. The affinity of the active material of the adsorbent unit 34 for ozone and the contaminants exposed to ozone generated by the unit 32 are adsorbed by the unit 34. A preferred adsorbent is activated carbon or charcoal. Moreover, by disposing the unit 34 downstream of the odor neutralizer unit 32, any excess ozone generated by the unit 32 is adsorbed by and converted back to oxygen by the adsorbent unit 34.

Treatment of the air flowstream passing through the system 22 is further preferably carried out by passing the air through a relatively high efficiency final filter unit, generally designated by the numeral 36 in FIG. 1. The filter unit 36 may be a so-called hospital grade filter formed of one or more layers of a suitable media such as a non-woven polymeric material. The filter unit 36 is typically capable of removing a substantial portion of particles larger than 0.10 microns, for example.

As shown in FIG. 1, the system 22 is operably connected to the peripheral slotlike opening 16 by way of a return conduit 38 which may be suitably connected to branch conduits 40*a*, 40*b*, 40*c* and 40*d*, for example, to provide relatively balanced distribution of air through the perimeter opening 16 to form a generally rectangular downward flowing air curtain. Accordingly, a relatively thin sheet or curtain of air is caused to flow down toward the floor 11 of the room or enclosure 10 and, due to withdrawal of the air from zone 12 through the opening 18, the air will flow inwardly and generally toward the center of the zone 12 for recirculation. The size of the perimeter opening 16 may be determined such as to minimize air velocity and noise to the extent that human occupants of the zone 12 will not notice the flow of air. Moreover, in accordance with the method and system of the invention, a preferred arrangement of the airflow ducting 20 and 38 is such that at least a portion of the air being discharged from the cabinet 24 may be caused to flow through branch discharge ducts 42*a* and/or 42*b* connected to conduit or duct 38 and opening into portions of the room or zone 10 adjacent to but spaced from the inner zone 12. In this way, a slight imbalance in the air flow leaving the zone 12 and being returned to the zone 12 through the opening 16 will be provided such that air will always flow into the zone 12 from the remainder of the room or zone 10. Thus, any contaminants being generated within the zone 12, such as tobacco smoke, will remain in the zone 12 and be treated by the system 24 for removal and will not flow out into the remainder of zone 10. The branch conduits or ducts 42*a* and 42*b* may, for example, also be connected to conventional air conditioning or ventilation ducting, not shown, for returning air to the zone 10 in a typical setting.

As shown in FIG. 1, the system 22 may include a sixth stage of air purification which includes means 44 for injecting certain odor maskers or neutralizers or certain aesthetically pleasing odorants into the return air flowstream to enhance the pleasantness of the environment in the zones 10 and 12. Since the presence of ozone, even after extraction of a substantial amount of same by the adsorbent stage 34, tends to have an olfactory dulling or desensitizing effect on human beings, it may be advantageous to enhance the environment which is being conditioned by treatment of the air by the system 22 to inject certain odor maskers, neutralizers or odorants. In this regard, FIG. 1 illustrates in schematic form an odorant source and injector, indicated at 44, which is preferably operably connected to the duct 38 or disposed in the cabinet 24 downstream of the final filter 36 in the direction of flow of conditioned air through the cabinet 24.

Figure 2:
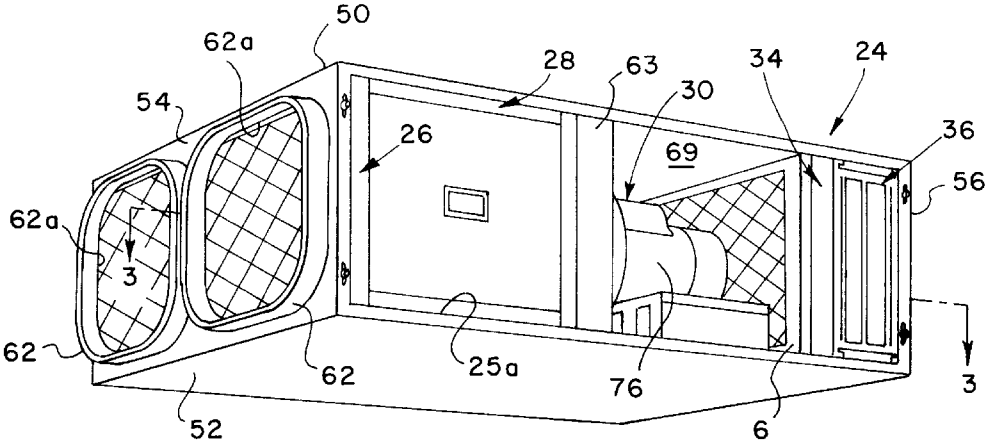
FIG. 2 is a perspective view of a preferred embodiment of an air purification system in accordance with the invention.
Figure 4:
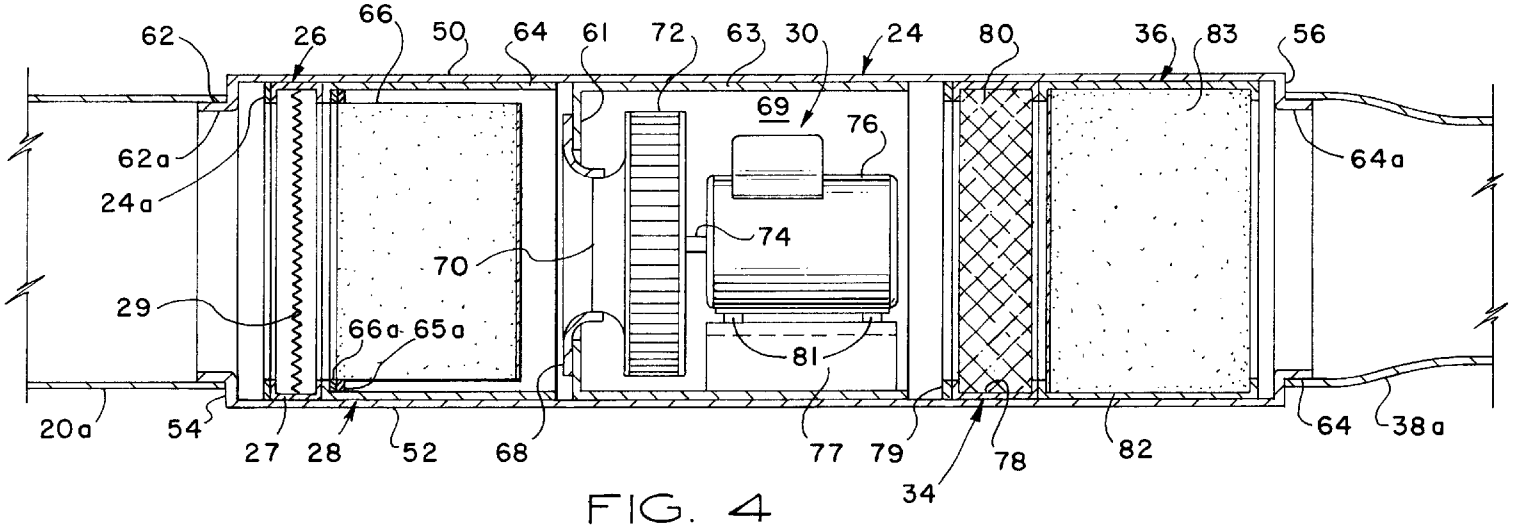
FIG. 4 is a section view taken generally from the line 4—4 of FIG. 3.
Figure 3:
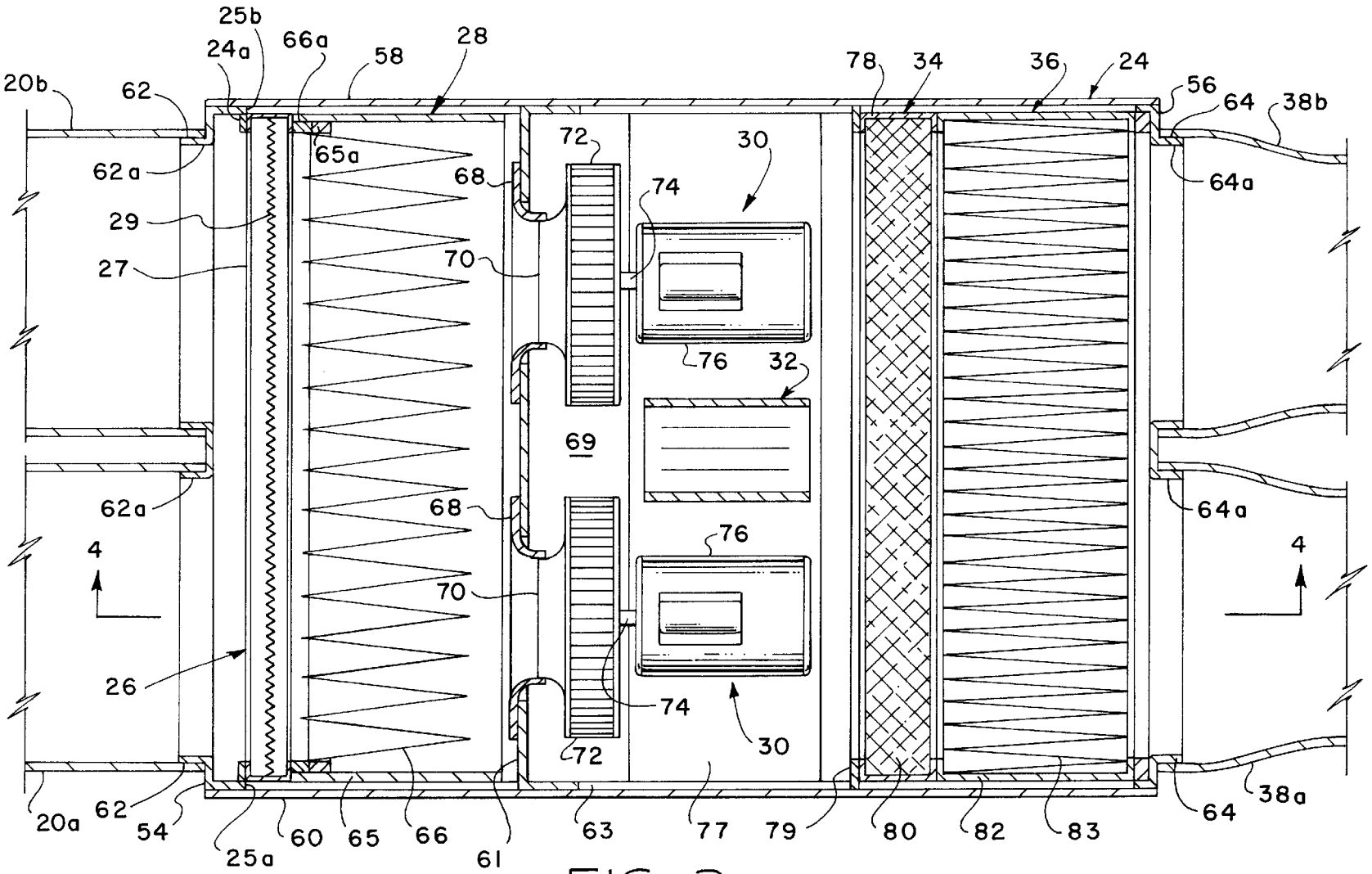
FIG. 3 is a section view of the system shown in FIG. 2 and taken generally along the line 3—3 of FIG. 2.

FIGS. 2 through 4 show certain details of a preferred embodiment of the cabinet 24 and the components disposed therein which are indicated schematically in FIG. 1. Referring to FIGS. 2 through 4, the cabinet 24 is preferably characterized as a generally rectangular hollow boxlike structure having a horizontal top wall 50, a bottom wall 52 and opposed end walls 54 and 56. As shown in FIG. 3, opposed side walls 58 and 60 are provided and one or both of these side walls may be suitably removably attached to the cabinet 24 by conventional fastener means, not shown, to provide access to the air treatment units disposed therein. In FIG. 2, the sidewall 60 has been removed to illustrate how access may be obtained to the units 26, 28, 30, 34 and 36, for example.

One advantage of the cabinet 24 is that its height is minimized to provide for ease in mounting the cabinet in false ceilings and other low headroom installations which otherwise might interfere with structural features of the building or room in which the system is disposed. In this regard, the end walls 54 and 56 are provided with adjacent, generally oblong flanges 62 and 64 projecting therefrom, respectively, which define openings 62*a* and 64*a* to and from the interior of cabinet 24. The flanges 62 and 64 are adapted to be connected to either substantially rigid, generally rectangular ducts or flexible generally circular ducts which may be deformed to be slipped over the flanges and suitably secured thereto by conventional band clamps or the like, not shown. In this way, conventional flexible cylindrical ducting may be configured for being connected to the cabinet 24. In this regard also, the circumference of the oblong flanges 62 and 64 is generally equivalent to, actually slightly less than, the circumference of the cylindrical ducting to which the flanges are secured. By way of example, as shown in FIGS. 3 and 4, the inlet ducting 20 is actually characterized by two separate ducts 20*a* and 20*b*, which are generally rectangular rigid duct while the air discharge ducting may be made up of the cylindrical flex duct 38*a* and 38*b* and which may be distorted to be secured to the cabinet 24 at the flanges 64 projecting from the end wall 56.

Referring further to FIGS. 3 and 4, the disposable or reusable electrostatic type coarse particle impingement filter unit 26 is shown disposed in the cabinet 24 contiguous with a peripheral support flange 24*a* adjacent the inlet ducts 20*a* and 20*b* and the end wall 54. As mentioned previously, the filter unit 26 may comprise a generally rigid rectangular perimeter frame 27 supporting a nonwoven polyester or polypropylene filter media 29. The filter units 26, 28, 34 and 36 may be inserted in and removed from the cabinet 24 through one or the other of opposed side openings 25*a* or 25*b*, FIGS. 2 and 3. The filter unit 26 may be of a type commercially available and sold under the trademark "DUST STAR" by Dustfree, Inc., Royce City, Tex.

As further shown in FIGS. 3 and 4, the cabinet 24 is provided with an intermediate transverse wall 61 generally parallel to the end walls 54 and 56 and defining a space between the filter unit 26 and the intermediate wall which is occupied by the second or primary stage particle filter unit 28. The wall 61 may form part of a rectangular frame 63 which also supports two side by side fan units 30, and which may be slidably insertable in and removable from cabinet 24 through openings 25*a* or 25*b*. The filter unit 28 is characterized by a generally rectangular box-like frame 65 in which a removable and disposable pleated bag-type filter media 66 is disposed. The media 66 is secured to a peripheral flange part 66*a* which engages a cooperating flange 65*a* of the frame 65. Accordingly, the frame 65 may be slidably removable from cabinet 24 and the media 66 replaced by a new media. The media 66 is preferably a fabric having an average dust spot efficiency of 95%, for example. The filter unit 28 may be of a type commercially available from Glassfloss Industries, Inc. of Millersport, Ohio as one of their "Excel" Series polyester bag-type filters.

As still further shown in FIGS. 3 and 4, the transverse intermediate wall 61 is adapted to support two spaced apart, generally cylindrical venturi or flow inducer members 68, which are operable to guide air flow to the respective fan units 30 and, particularly into inducer portions 70 of spaced apart closed face centrifugal fan or blower impellers 72 which are each mounted on the output drive shafts 74 respectively, of conventional AC electric induction motors 76. The impellers 72 are preferably of a high efficiency backward curved blade type available from Continental Fan Corporation, Chicago, Ill. under the trademark "REVERSE JET". For a filtration and purification system 22 having an air flow throughput of 2240 standard cubic feet per minute (SCFM) maximum, with a final filter stage 95% DOP, the impellers 72 are each sized to have an airflow capacity of 1600 SCFM at 3700 RPM. The induction motors 76 for a system 22 having the above mentioned air flow capacity are preferably each rated at 1.50 horsepower.

As shown in FIGS. 3 and 4, the impellers 72 are mounted within the cabinet 24 on frame 63 and within an interior chamber or space 69 between wall 61 and adsorbent unit 34. The impellers 72 are spaced apart sufficiently to leave suitable space between the motors 76 to provide support by frame 63 for the electronic odor neutralizer 32 comprising the aforementioned ozone generator. At least a significant portion of air flowing through the cabinet 24 may pass through or mix with ozone generated by the neutralizer unit 32. The ozone generator may be of a type commercially available such as from Dust Free, Inc. of Royce City, Tex., and is adapted to operate on 120 volt, 60 $H_z$ AC electrical power and provide a nominal output voltage of 6000 volts.

The activated carbon adsorbent unit 34 is disposed just downstream of the odor neutralizer unit 32 and is characterized by a generally rectangular perimeter frame 78 in which an adsorbent media 80 is retained by suitable screening. The unit 34 may be at least partially supported in the cabinet 24 by a perimeter flange 79. The media 80 may comprise, for example, particulate, activated carbon in the amount of 600 grams per square foot of surface area exposed to airflow and having a 60% minimum activity rating. The activated carbon media 80 may be of a type particularly adapted to be effective for adsorbing gaseous compositions generated by burning tobacco products. The adsorbent unit 34 may also be of a type commercially available from Dust Free, Inc.

Lastly, the high efficiency or ultrahigh efficiency particle removal filter unit 36 is disposed directly adjacent the unit 34 and is preferably formed to have a generally rectangular perimeter frame 82 supporting a filter media 83 and dimensioned to fit within the cabinet 24. The unit 36 is insertable in or removable from the cabinet 24 through the openings 25*a* or 25*b* in the same manner as the units 26, 28 and 34. Depending on the degree of filtration required of the system 22, the filter unit 36 may, for example, have a particle removal rate of 99.97% for particles greater than 0.12 microns, for example. One source of a suitable filter having the above-mentioned performance parameters may be a Hospital Filter available from Donaldson Company, Minneapolis, Minn., and utilizes a pleated polyester nonwoven fabric media 83.

The entire exterior of the cabinet 24 may be suitably covered with a layer of sound insulation material of conventional construction, not shown in FIGS. 2 through 4, in order to reduce sound emissions from the system 22. As shown in FIG. 4, the motors 76 may be mounted on a suitable sound isolating support 77 forming part of frame 63, and including conventional elastomeric motor mounts 81.

Figure 5:
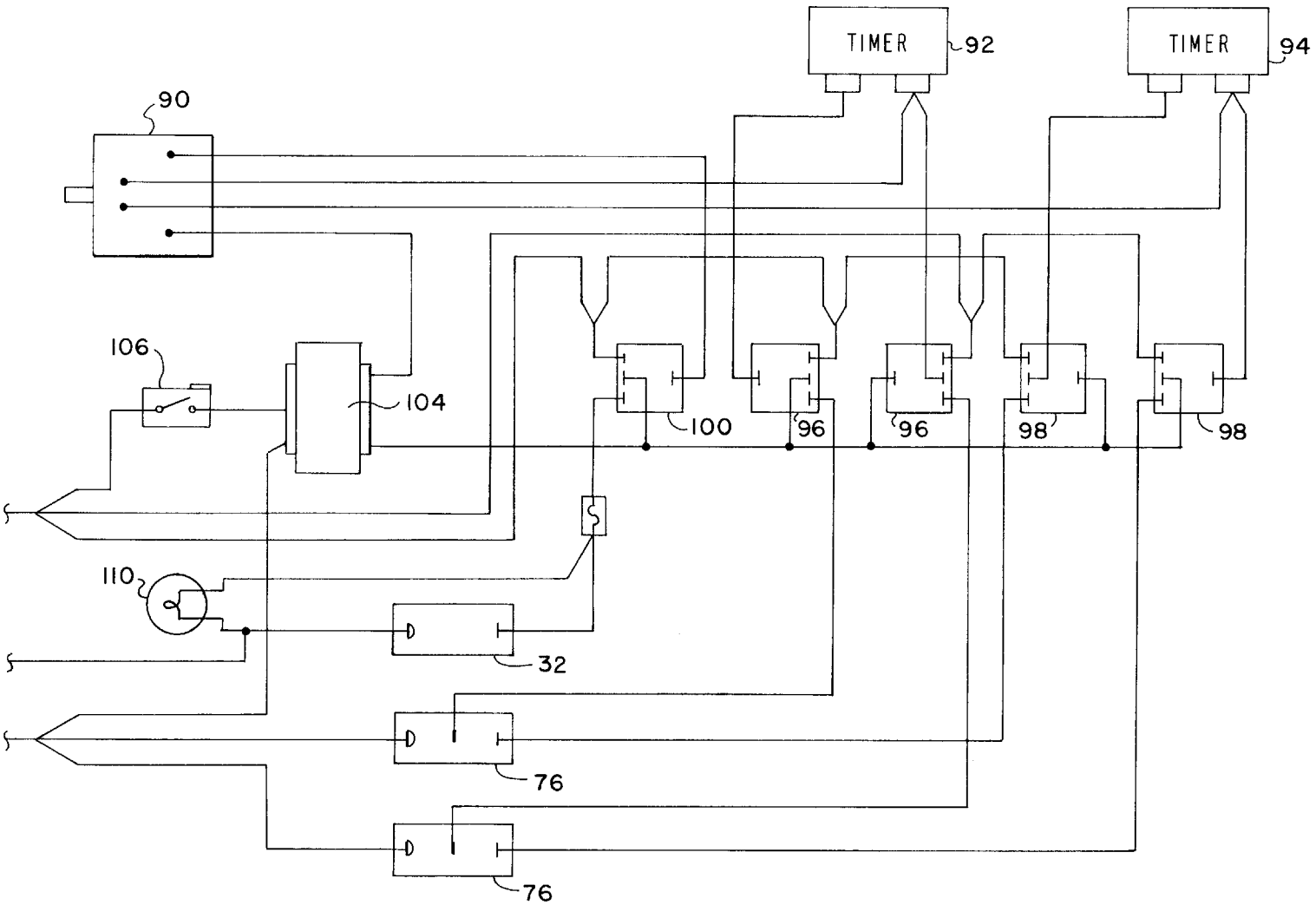
FIG. 5 is a schematic diagram of a control system for a preferred embodiment of the present invention.

The fan motors 76 and the odor neutralizer unit 32 may be controlled by a suitable control circuit illustrated in FIG. 5. Remote control of operation of the air filter and purification system 22 may be carried out by operation of a suitable remote switch 90 operably connected to an electrical circuit which includes a conventional 220 volt AC electrical power source, not shown. The control circuit shown in FIG. 5 includes two time delay relays 92 and 94, which are connected, as shown, to power relays 96 and 98 for operating the fan motors at two speeds. A fifth relay 100 is operable to provide 110 volt AC power to ozone generator unit 32. The relays 96, 98 and 100 operate on 24 volt AC electrical power supplied by a suitable transformer 104. The transformer 104 is disabled by a cabinet access panel door switch 106 which is activated on removal of the removable sidewall 60, for example, when access to the interior of the cabinet 24 is desired.

The control elements shown in FIG. 5, except for the switch 90, may be disposed in a suitable enclosure, not shown, within the interior of the cabinet 24. The operating condition of the ozone generator 32 may be indicated by a suitable indicator lamp 110 shown in the circuit of FIG. 5 and mounted in an appropriate place for easy viewing by an operator of the system 22 and when the operating condition of the ozone generator is desired to be known. The time delay relays 92 and 94 are set to start the fan motors 76 at separate times upon actuation of the switch 90 to reduce current demand during startup of the system 22 or upon a change in speed of the motors from low to high speed. The components illustrated in the schematic diagram of FIG. 5 may all be of types commercially available, including the motors 76.

A selection of the size of the system 22 in terms of nominal volumetric flow rate of air throughput is primarily based on environmental conditions within and the size of the zone to be treated and conditioned. For dust and other allergens control, an air exchange rate should be on the order of fifteen minutes, that is, the flow rate of the system 22 should be such as to replace the entire volume of the zone being treated every fifteen minutes. In the event of moderate tobacco smoke generation and chemical vapor control or heavy smoke generation and chemical vapor control, the air exchange rate should be on the order of six to fifteen minutes.

Thanks to the configuration of the cabinet 24, the system 22 may be mounted below a ceiling and operated without ducting. For a system 22 having an airflow and filtration and purification rating, as mentioned previously, the cabinet 24 may be no more than about 16.0 inches in height by 36.0 inches width and 47.0 inches in length between endwalls 54 and 56. However, in most installations the system 22 is preferably mounted above a so-called T bar type false ceiling with the intake and discharge ducting appropriately located also in the space provided by such a ceiling. The configuration of the cabinet 24, as described above, permits the attachment of two sixteen inch diameter ducts to either the inlet or outlet flanges or conventional insulated flex or steel ducting may also be used.

The fabrication and operation of the air purification system 22 in accordance with the invention is believed to be within the purview of one of ordinary skill in the art based on the foregoing description. Conventional engineering materials and components not specifically identified above and used in the heating, ventilating and air conditioning industry may be utilized in fabricating the system 22. Although a preferred embodiment of the invention has been described in detail herein, those skilled in the art will recognize that various substitutions and modifications may be made to the system and method without departing from the scope and spirit of the appended claims.

What is claimed is:

1. An air filtration and purification system for withdrawing air from a predetermined zone and returning purified air to said zone, said system comprising;

a plurality of units arranged in series with respect to an air flowstream withdrawn from a predetermined zone and to be returned to said zone, said plurality of units comprising, a first stage electrostatic particle filter unit interposed in said air flowstream for removing particulate material in a particle size range of between about 1.0 microns and 10.0 microns from said air flowstream, a second stage impingement filter unit including a high density microfiber filter media for removing particulates having a particle size greater than about 0.3 microns from said air flowstream which has passed through said first stage filter unit, an adsorbent unit for adsorbing gaseous compositions disposed in said air flowstream which has passed through said second stage filter unit, a third stage filter unit including a filter media operable to remove particulates having a nominal particle size greater than about 0.1 microns from said air flowstream which has passed through said second stage filter unit and said adsorbent unit;

means disposed in said air flowstream between said second stage filter unit and said adsorbent unit for providing a composition operable to agglomerate fine particulates to provide larger particulates and to bond to molecules of gases and vapors in said air flowstream for removal of said gases and vapors by said adsorbent unit and removal of said larger particulates by said third stage filter unit; and a motor driven fan disposed in said system between said second stage filter unit and said adsorbent unit for propelling said air flowstream through said system to treat said air flowstream for return to said zone.

2. The system set forth in claim 1 wherein:

said units are disposed in a cabinet, said cabinet including means for connecting said system to an air inlet duct and an air discharge duct;

said cabinet includes a transverse wall interposed between said second stage filter unit and said motor driven fan;

said motor driven fan includes an air flow inducer supported on said transverse wall; and said motor driven fan comprises a centrifugal impeller having an inducer section disposed adjacent to said air flow inducer supported by said transverse wall and operable to discharge air into an interior space in said cabinet between said transverse wall and said adsorbent unit.

3. The system set forth in claim 2 including:

plural motor driven fans disposed side by side, each of said fans including an inducer supported by said transverse wall and a centrifugal impeller disposed adjacent said inducer, and connected to a motors for driving said impeller, for discharging air into said space in said cabinet between said transverse wall and said adsorbent unit.

4. The system set forth in claim 3 including:

control means for controlling at least one of starting of respective ones of said motors and controlling the speed of said motors, said control means including a time delay relay for controlling a change in the speed of rotation of one of said fans at a predetermined time with respect to a change in the speed of rotation of another of said fans.

5. The system set forth in claim 2 wherein:

said means comprises an ozone generator for providing ozone as said composition and said ozone generator is disposed in said space between said transverse wall and said adsorbent unit.

6. The system set forth in claim 1 including:

odorant injection means connected to said system for injecting an odorant into said air flowstream downstream of said third stage filter unit with respect to the direction of air flow through said system.

7. The system set forth in claim 1 including:

duct means for conducting purified air to said zone, said duct means being connected to a perimeter opening defining a boundary of said zone for returning said purified air to said zone in the form of an air curtain disposed at said boundary.

8. The system set forth in claim 1 including:

duct means for removing air from said zone for flow through said system, return duct means for returning air from said system to said zone and branch duct means for conducting air from said system to an area adjacent said zone to provide a flow imbalance at said zone so as to cause airflow into said zone from said adjacent area to minimize the flow of contaminated air out of said zone except through said duct means for removing air from said zone.

9. A system for removing contaminated air from a zone within an interior room of a building and returning treated air to said zone, said system comprising:

a perimeter opening defining at least part of a zone within an interior room for conducting air in a perimeter flowstream to delimit said zone and to prevent cross contamination of air within said zone with air in an adjoining space in said room, said adjoining space and said zone in said room being substantially devoid of physical barriers which would prevent flow of air therebetween;

means defining an opening to said zone for removing contaminated air therefrom;

duct means connected to said means defining said opening to said zone for withdrawing air from said zone and for conducting air in an air flowstream to an air filtration and purification unit;

an air filtration and purification unit including, in series arrangement, a first stage particle filter interposed in said air flowstream, a second stage particle filter interposed in said air flowstream downstream of said first stage filter, an ozone generator interposed in said air flowstream downstream of said second stage filter, a gaseous composition adsorbent interposed in said air flowstream downstream of said ozone generator, a third stage particle filter interposed in said air flowstream downstream of said adsorbent and a motor driven fan for propelling air withdrawn from said zone through said unit;

return duct means connected to said perimeter opening for returning purified air to said zone; and branch duct means for conducting purified air from said return duct means to an area in said adjoining space adjacent said zone to cause a flow imbalance in said zone so as to provide for air flow into said zone from said adjoining space and to minimize the flow of contaminated air out of said zone except through said duct means for withdrawing air from said zone.

10. The system set forth in claim 9 wherein:

said first stage filter includes a filter media operable to filter particles from said air flowstream having a particle size greater than about 1.0 microns.

11. The system set forth in claim 9 wherein:

said second stage filter includes a filter media operable to filter particles from said air flowstream having a particle size greater than about 0.3 micron.

12. The system set forth in claim 9 wherein:

said third stage filter includes a filter media operable to filter particles having a particle size greater than about 0.10 microns.

13. The system set forth in claim 9 including:

odorant injection means associated with said system for injecting an odorant into said air flowstream downstream of said third stage filter with respect to the direction of air flow through said system.

14. A method for filtering and purifying air from a zone within an interior room of a building, comprising the steps of:

withdrawing contaminated air from a zone within an interior room of a building with an air propulsion unit, said zone and an adjoining space in said room being substantially devoid of physical barriers which would prevent flow of air therebetween;

passing said air withdrawn from said zone through a first stage particle filter and removing particles having a size greater than about 1.0 microns;

passing air from said first stage filter through a second stage particle filter and removing particles having a size greater than about 0.30 microns;

mixing an air flowstream from said second stage filter with a composition operable to agglomerate fine particulates into larger particulates and to bond to molecules of gases and vapors in said air flowstream;

passing air mixed with said composition through an adsorbent to remove at least one of volatile organic compounds, fine smoke particles and products of combustion from air mixed with said composition;

passing air from said adsorbent through a particle filter for removing particles having a particle size greater than about 0.10 microns;

returning purified air to said zone through a perimeter duct defining a perimeter of said zone; and returning at least part of said purified air to a point in said adjoining space in said room and spaced from said zone so that a flow imbalance is created at said zone to cause air to flow into said zone from said adjoining space in said room and to substantially prevent contaminates generated within said zone from flowing out of said zone into said adjoining space in said room.

15. The method set forth in claim 14 including the step of:

placing said air propulsion unit between said second stage particle filter and said adsorbent.

* * * * *